United States Patent [19]

Fukao et al.

[11] Patent Number: 4,953,484

[45] Date of Patent: Sep. 4, 1990

[54] OVEREDGE SEWING MACHINE FOR CUTTING THE EDGE OF A FABRIC WHILE SEWING AN OVEREDGE STITCH

[75] Inventors: Hiroaki Fukao, Kasugai; Teruhiko Ohkita, Nagoya; Nobusuke Nagasaka, Aichi; Tateo Ueno, Mizunami, all of Japan

[73] Assignee: Brother Kogyo Kabushiki Kaisha, Japan

[21] Appl. No.: 355,677

[22] Filed: May 23, 1989

[30] Foreign Application Priority Data

May 26, 1988 [JP] Japan ..... 63-129370
May 28, 1988 [JP] Japan ..... 63-131070

[51] Int. Cl.[5] ..... D05B 37/06
[52] U.S. Cl. ..... 112/162; 112/126
[58] Field of Search ..... 112/126, 162, 177, 314, 112/315

[56] References Cited

U.S. PATENT DOCUMENTS 4,570,558 2/1986 Hirayama et al. ..... 112/162
4,690,079 9/1987 Satoma ..... 112/162

FOREIGN PATENT DOCUMENTS 59-101185 6/1984 Japan .
60-40277 3/1985 Japan .

*Primary Examiner*—Werner H. Schroeder
*Assistant Examiner*—David K. Suto
*Attorney, Agent, or Firm*—Oliff & Berridge

[57] ABSTRACT

In this overedge sewing machine, when stitch width is adjusted, an adequate excess thread proportional to the adjusted stitch width is obtained. An overedge stitch can be steadily sewn without excessive stitch tension, even when the stitch width increases. By operating one adjustment member, the position of the lower knife holder and the stitch-support member can be easily adjusted, and the stitch width can thus be easily altered.

10 Claims, 6 Drawing Sheets

OVEREDGE SEWING MACHINE FOR CUTTING THE EDGE OF A FABRIC WHILE SEWING AN OVEREDGE STITCH

BACKGROUND OF THE INVENTION

This invention relates to an overedge sewing machine for cutting the edge of a fabric and sewing an overedge stitch at the same time.

The U.S. Pat. No. 4570558 discloses one known overedge sewing machine. In this prior-art overedge sewing machine, a lower knife holder supporting a lower knife crosses the fabric-feed direction at a right angle. When an adjustment knob is rotated, an external screw is engaged with an internal screw, the lower knife holder is moved, and stitch width is thus adjusted. A stitch-support member is fixed on the lower knife holder. When the stitch width is altered, the stitch-support member is moved together with the lower knife holder.

Generally, an excess amount of upper and lower looper thread is necessary for the thread to reciprocate between the needle location and the fabric edge. Excess thread in proportion to the stitch width is also necessary. In this prior art, an adequate amount of reciprocating thread corresponding to the stitch width can be obtained. However, since the stitch-support member moves together with the lower knife and the relative position of the stitch-support member with the lower knife does not change, an adequate amount of excess thread proportional to the stitch width cannot be obtained. The amount of thread is so insufficient that the stitch becomes too taut when the adjusted stitch width increases.

Another known overedge sewing machine is disclosed in the U.S. Pat. No. 4690079. In this prior-art overedge sewing machine, the lower knife holder supporting the lower knife crosses the cloth feed direction at a right angle. When the adjustment knob is rotated, a movable member is moved and the external screw is engaged with the internal screw. The lower knife holder is moved accordingly, and the stitch width is thus adjusted. The stitch-support member attached to the movable member crosses the fabric-feed direction at a right angle. After the stitch width is adjusted, the position of the stitch-support member can be finely adjusted by loosening a set screw.

In this prior art, when the stitch width is altered, the position of the lower knife holder should be adjusted, then that of the stitch-support member should be finely adjusted. On the other hand, the movable member of the lower knife holder supports the stitch-support member, so the stitch-support member moves together with the lower knife holder when the stitch width is altered. Every time the stitch width is adjusted, the position of the stitch-support member must be finely adjusted according to the type of the fabric.

SUMMARY OF THE INVENTION

One object of the invention is, therefore, to provide an overedge sewing machine where, by securing an adequate excess thread proportional to an adjusted stitch width, a stitch can be steadily formed regardless of the stitch width without increasing the tension in the threads.

Another object of the invention is to provide an overedge sewing machine where the position of the lower knife holder supporting the lower knife and that of the stitch-support member can be adjusted easily using one adjustment member.

According to the present invention there is provided an overedge sewing machine comprising:

upper and lower knives disposed on the feed side in front of a needle location for cutting an edge of a fabric (W) being fed toward the needle location;

a lower knife holder movable in a direction perpendicular to the fabric-feed direction for supporting the lower knife;

a stitch-support member near the needle location, extending away from the feed side and movable in the direction perpendicularly to the fabric-feed direction;

an adjustment member for adjusting the stitch width;

displacement means responsive to said adjustment member for moving said lower knife holder and said stitch-support member by first and second displacement amounts respectively on movement of said adjustment member by a given amount.

BRIEF DESCRIPTION OF THE DRAWINGS

The invention may be best understood by referring to the following description of the preferred embodiments of the invention and the drawings in which.

DETAILED DESCRIPTION OF THE PREFERRED EMBODIMENTS

Figure 1:
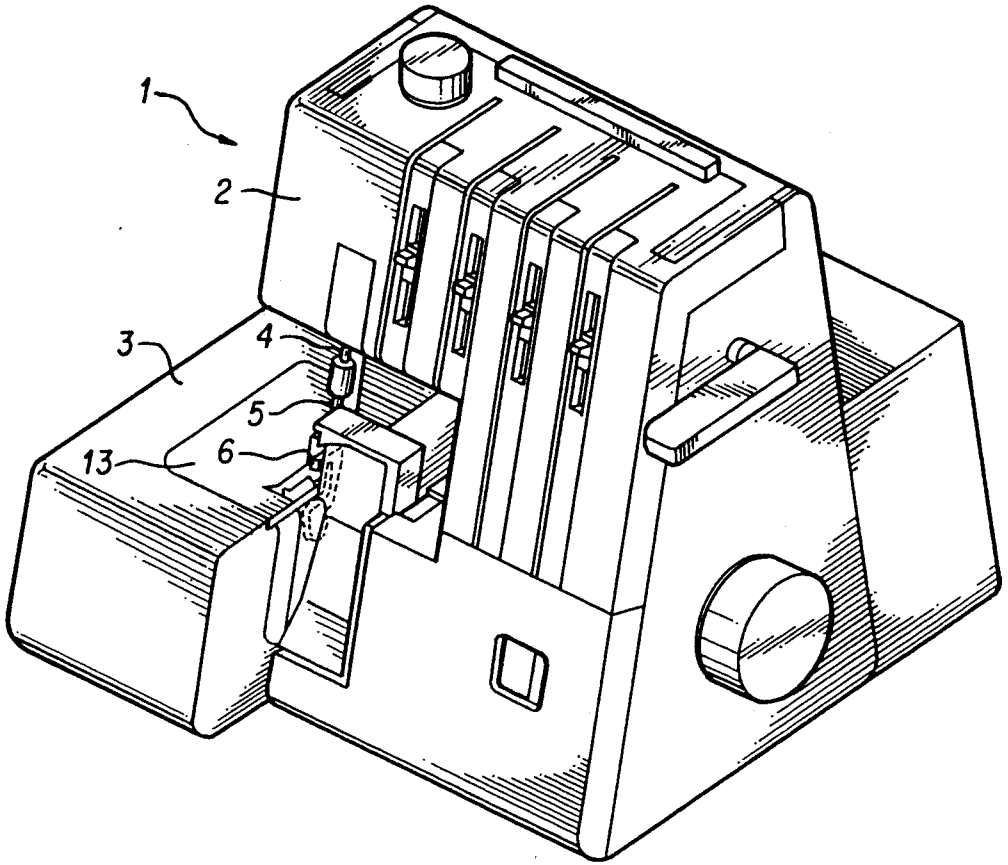
FIG. 1 is a perspective view of an overedge sewing machine for the described embodiments of the invention.

Embodiments of the present invention will be described referring to the drawings.

As shown in FIG. 1, a sewing machine body 1 comprises an arm 2 and a bed 3. The arm 2 has a needle bar 4. A needle 5 attached to the lower edge of the needle bar 4 sews an overedge stitch S on the edge of fabric W in cooperation with a known looper provided in the bed 3. An upper knife 6 is movably attached on the operator's side in front of a needle location in the bed 3. The upper knife 6 and a lower knife 7 fixed to the bed 3 cooperate to cut the edge of the fabric W being fed toward the needle location before overedge stitch is sewed.

Figure 2:
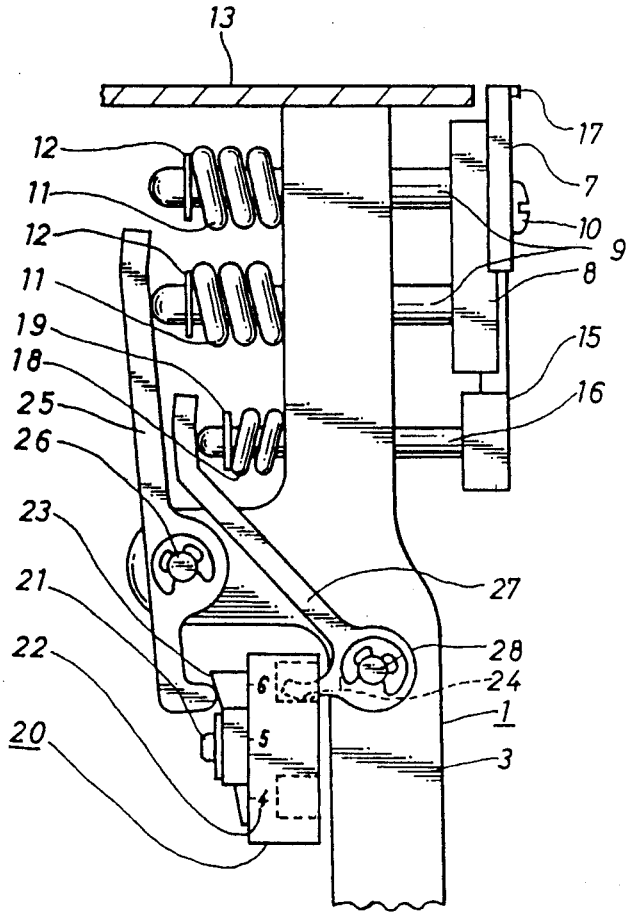
FIG. 2 is a partial front sectional view showing a lower knife holder and a stitch-support member for the embodiments.

The structure for supporting and adjusting the lower knife 7 is now explained. As shown in FIG. 2, a lower knife holder 8 is movably attached through a pair of support pins 9 to the bed 3, and can cross the fabric-feed direction at a right angle. The lower knife 7 is fixed with a screw 10 to the right side of the lower knife holder 8. Compression springs 11 are inserted between the bed 3 and spring washers 12 fixed at the tips of the pins 9. The resilience of the compression spring 11 moves the lower knife holder 8 to the left in FIG. 2.

Figure 3A:
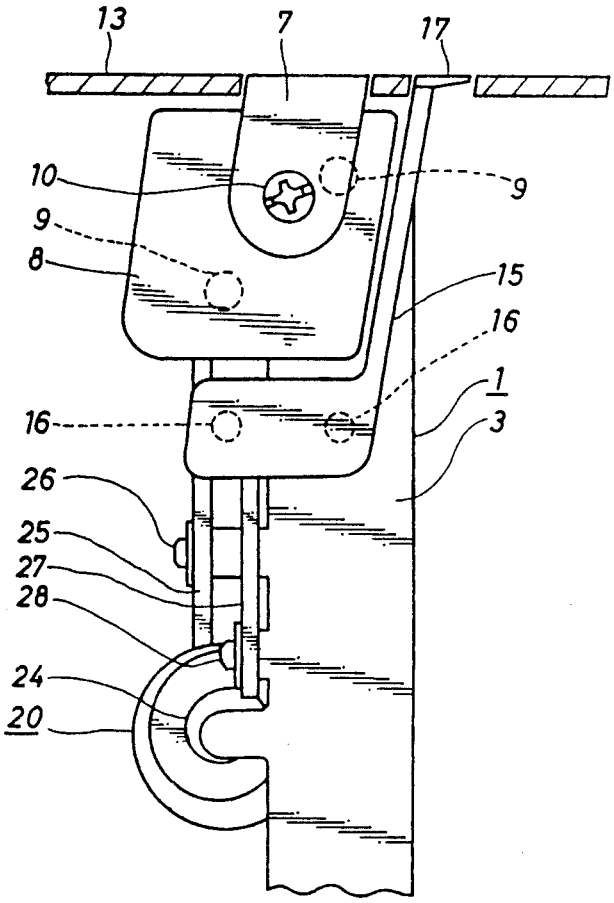
FIG. 3A is a side sectional view of FIG. 2 for the first embodiment.
Figure 5:
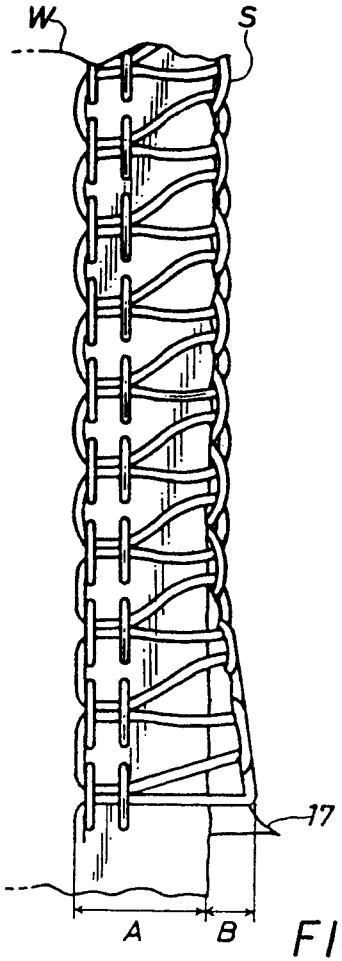
FIG. 5 illustrates stitch formation at the edge of the fabric.
Figure 4:
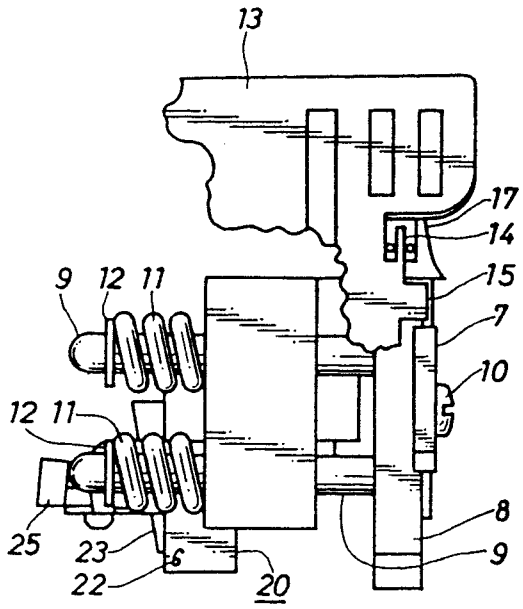
FIG. 4 is a partial top view of FIG. 2.

A needle plate 13 is fixed on the top of the bed 3 of the sewing machine body 1. As shown in FIG. 4, a stationary stitch-support member 14 is fixed near the needle location extending away from the operator. As shown in FIGS. 2 and 3A, a movable member 15 is adjacent to the lower knife holder 8. The movable member 15 is attached through a pair of support pins 16 to the bed 3, and can cross the fabric-feed direction at a right angle. A movable stitch-support tongue 17 is attached to the top of the movable member 15 near the needle location in the fabric-feed direction. As shown in FIG. 5, the movable stitch-support tongue 17 and the stationary stitch-support member 14 temporarily hold the overedge stitch S between each other. Compression springs 18 are inserted between the bed 3 and spring washers 19 provided at the tips of the pins 16. The resilience of the springs 18 moves the movable member 15 to the left in FIG. 2.

Figure 6:
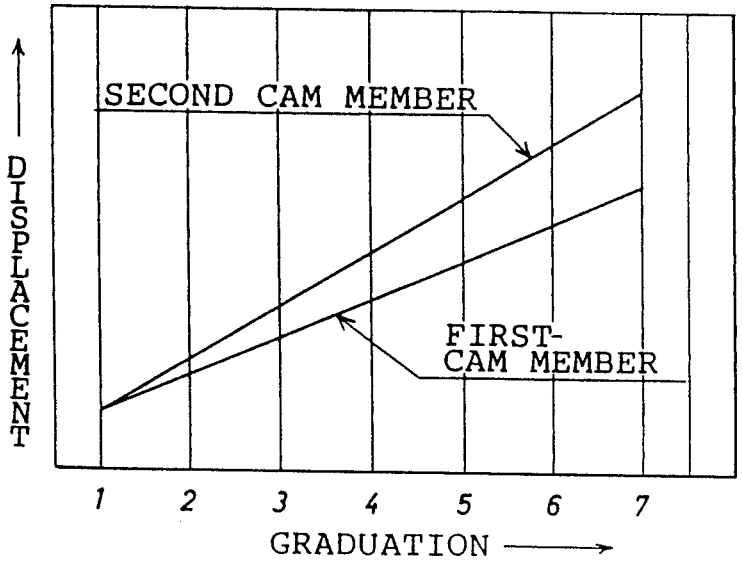
FIG. 6 is a graph showing the displacement of cam members in the first embodiment.

An adjustment member 20 for adjusting stitch width is rotatably attached through a shaft 21 to the bed 3 of the sewing machine body 1. On the periphery of the adjustment member 20, graduation marks 22 marking the stitch width are provided. First and second cam members 23 and 24 are respectively incorporated into each side of the adjustment member 20. The first cam member 23 comprises a horizontal-movement-producing cam and the second cam member 24 comprises a vertical-movement-producing cam. As shown in FIG. 6, in this embodiment, the displacement due to the second cam member 24 is greater than that due to the first cam member 23.

As shown in FIG. 2, a first transmission lever 25 is rotatably attached through a shaft 26 to the bed 3. One end of the first transmission lever 25 engages the first cam member 23, and the other end engages a support pin 9 supporting the lower knife holder 8. A second transmission lever 27 is rotatably attached through a shaft 28 to the bed 3. One end of the second transmission lever 27 engages the second cam member 24, and the other end engages a pin 16 supporting the movable member 15. The first and second transmission levers 25 and 27 compose a transmission means for individually moving the lower knife holder 8 and the movable member 15 of the stitch-support tongue 17 based on the displacements due to the first and second cam members 23 and 24, respectively.

In this embodiment, when the adjustment member 20 is rotated according to the graduation marks 22 indicating stitch width, the first cam member 23 operates the first transmission lever 25 causing the lower knife holder 8 supporting the lower knife 7 to cross the fabric-feed direction at a right angle. At the same time, the second cam member 24 operates the second transmission lever 27 causing the movable member 15 with the stitch-support tongue 17 to move in the same direction as the lower knife holder 8. The upper knife 6 is also moved so that it continues to cooperate with the lower knife so as to cut the fabric. The stitch width is thus adjusted. As shown in FIG. 6, the second cam member 24 is displaced more than the first cam member 23. When the stitch width changes, the stitch-support tongue 17 moves more than the lower knife holder 8.

While the upper knife 6 cuts the edge of the fabric W in cooperation with the lower knife 7, the needle 5 sews the overedge stitch S in cooperation with the known looper. As shown in FIG. 5, the overedge stitch S is temporarily held by and between the stitch-support member 14 and the stitch-support tongue 17. When the stitch width is adjusted by rotating the adjustment member 20, the stitch-support tongue 17 moves more than the lower knife holder 8, so the stitch-support tongue 17 moves apart from the stationary stitch-support member 14. An amount A of thread reciprocating the width of the stitch and an excess amount B of thread both increase. By adjusting only the adjustment member 20, the overedge stitch steadily forms without excessive tension in the thread.

Figure 3B:
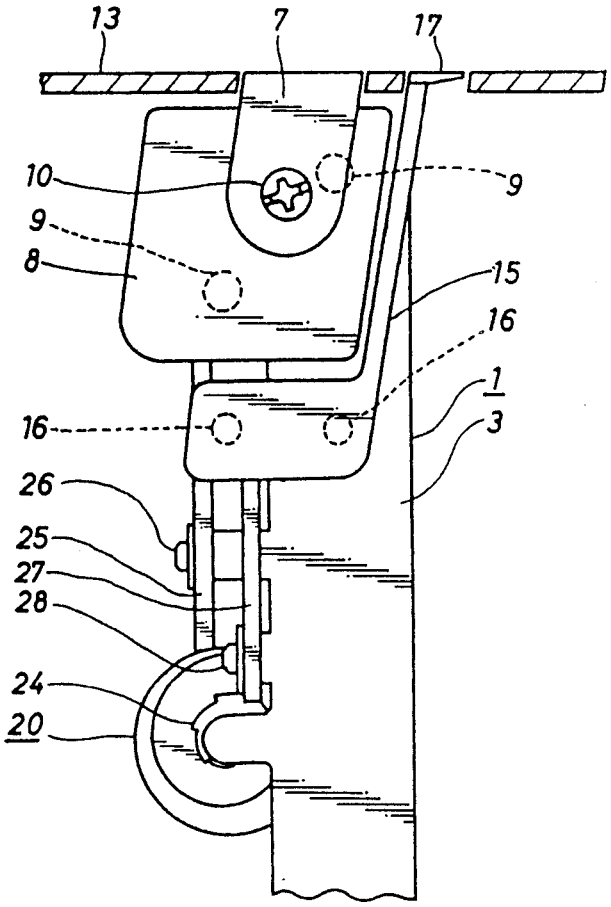
FIG. 3B is a side sectional view of FIG. 2 for the second embodiment.

Another embodiment of the present invention will be explained with reference to the drawings. A second embodiment has the same construction as the first embodiment as shown in FIGS. 1, 2, and 4. However, the configuration of the second cam member 24 in the second embodiment in FIG. 3B differs from that in the first embodiment in FIG. 3A.

Figure 7:
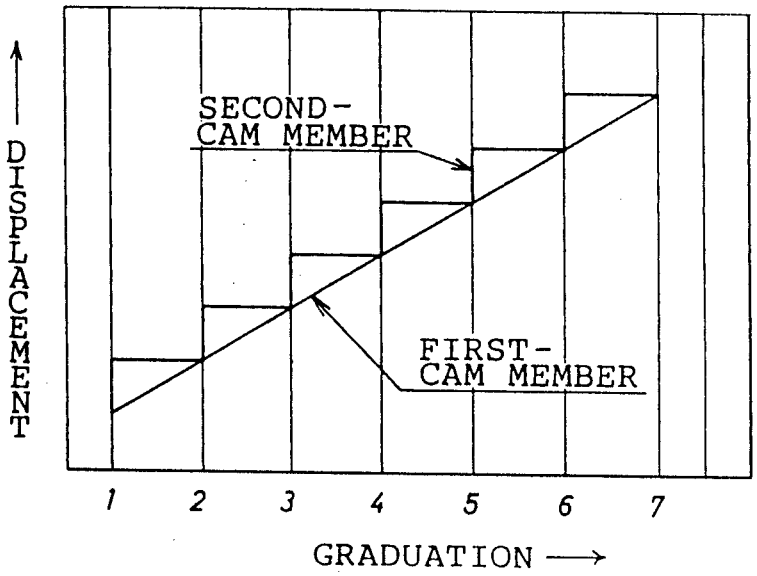
FIG. 7 is a graph showing the displacement of cam members in the second embodiment.

In the second embodiment, as shown in FIG. 7, the first cam member 23 has a continuous displacement. The second cam member 24 is displaced by almost the same amount as the first cam member 23, but its displacements are discrete.

In operation, while the upper knife 6 cuts the edge of the fabric W in cooperation with the lower knife 7, the needle 5 sews the overedge stitch S in cooperation with the known looper. When the adjustment member 20 is rotated, the first and second cam members 23 and 24 operate the first and second transmission levers 25 and 27, and the lower knife holder 8 and the movable member 15 move at right angles to, the fabric-feed direction by almost the same amount. The stitch width is thus adjusted. When the edge of the fabric W is cut and overedge stitch S is sewn, the fabric W, held by a known presser foot assembly, stretches toward the lower knife 7. When the fabric W is released from the presser foot assembly, the fabric W contracts to regain its original length. The expansion and contraction coefficient of the fabric W varies widely with the type of the fabric W. To adjust the stitch width, the relative position between the lower knife 7 and the stitch-support tongue 17 should be finely adjusted according to the type of the fabric W.

In the second embodiment, after the adjustment member 20 is rotated according to the graduation marks 22 for the stitch width, the adjustment member 20 is finely rotated within a graduation. Then, the first cam member 23 moves the lower knife holder 8 slightly within a graduation in the direction crossing the fabric-feed direction perpendicularly. However, since the second cam member 24 is in phase with a graduation on the adjustment member 20, the movable member 15 having the stitch-support tongue 17 does not move when a fine adjustment is made within a graduation. Consequently, the relative positions of the lower knife 7 and the stitch-support tongue 17 can be adjusted precisely and easily according to the type of the fabric.

These are only two possible embodiments of the invention claimed below. These embodiments are only illustrations of the claims, and in no way restrict the scope of the claims.

For instance, the cam members could be provided separately from the adjustment member. The cam members could be operated via a drive shaft by the adjustment member. One cam member could move both the lower knife holder and the stitch-support member individually by different amounts by means of the transmission levers with different lever lengths.

Furthermore, the first cam member could be displaced discretely, and the second cam member can be displaced continuously.

Thus, this invention includes all equivalent embodiments and modifications that come within the scope of the claims.

What is claimed is:

1. An overedge sewing machine comprising:

a needle location for holding a needle, said needle location having a feed side over which fabric is fed prior to reaching the needle location, fabric being fed toward the needle location in a fabric-feed direction;

upper and lower knives disposed on the feed side of the needle location for cutting an edge of a fabric being fed toward the needle location;

a lower knife holder movable in a direction perpendicular to the fabric-feed direction for supporting the lower knife;

a stitch-support member near the needle location, extending away from the feed side and movable in the direction perpendicular to the fabric-feed direction;

an adjustment member for adjusting the stitch width;

displacement means responsive to said adjustment member for moving said lower knife holder and said stitch-support member by first and second displacement amounts respectively on movement of said adjustment member by a given amount.

2. A sewing machine according to claim 1 wherein continuous motion of said adjustment member causes continuous change in said first and second displacement amounts.

3. A sewing machine according to claim 1 wherein continuous motion of said adjustment member causes continuous change in said first displacement amount and stepwise change in said second displacement amount.

4. A sewing machine according to claim 1 wherein a given displacement of said adjustment member causes greater change in said second displacement amount than said first displacement amount.

5. A sewing machine according to claim 1, wherein the adjustment member is rotatably attached through a shaft to a bed.

6. A sewing machine according to claim 1 wherein a periphery of the adjustment member bears graduation marks indicating the stitch width.

7. A sewing machine according to claim 1 wherein said displacement means comprises cam means which comprises first and second cam members and transmission means bearing on said cam members for respectively moving said lower knife holder and said stitch support member by first and second displacement amounts upon displacement of said adjustment member.

8. A sewing machine according to claim 7, wherein the first cam member is an inclined surface of the adjustment member and the second cam member is an eccentric channel in the adjustment member.

9. A sewing machine according to claim 8, wherein said eccentric channel includes a stepped inner peripheral surface so that the relative position between the lower knife and the stitch-support member can be adjusted.

10. A sewing machine according to claim 7, wherein the transmission means comprises:

a first transmission lever rotatably attached through a shaft to a bed, one end of said first transmission lever engaging the first cam member, and the other end engaging with a first support pin supporting the lower knife holder; and a second transmission lever rotatably attached through a shaft to the bed, one end of the second transmission lever engaging the second cam member, and the other end engaging a second support pin supporting a movable member, which moves the stitch-support member.

* * * * *